US007318799B2

(12) United States Patent
Rohrbach et al.

(10) Patent No.: US 7,318,799 B2
(45) Date of Patent: Jan. 15, 2008

(54) BUCKLE FOLDING MACHINE WITH FOLDING POCKET CASSETTE

(75) Inventors: Joerg Rohrbach, Marbach (DE); Eberhard Krieger, Weinstadt-Struempfelbach (DE); Claus-Dieter Redmer, Oppenweiler (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 138 days.

(21) Appl. No.: 11/361,971

(22) Filed: Feb. 27, 2006

(65) Prior Publication Data

US 2006/0229181 A1 Oct. 12, 2006

(30) Foreign Application Priority Data

Apr. 7, 2005 (DE) ..... 20 2005 005 532 U

(51) Int. Cl.
*B31F 1/00* (2006.01)

(52) U.S. Cl. ..... 493/419; 493/420

(58) Field of Classification Search ..... 493/419, 493/420, 442, 434, 435

See application file for complete search history.

(56) References Cited

U.S. PATENT DOCUMENTS 4,484,905 A * 11/1984 Ashburner ..... 493/415
4,585,219 A * 4/1986 Lehmann et al. ..... 270/46
4,619,101 A * 10/1986 Havey et al. ..... 53/117
5,000,432 A 3/1991 Krasuski et al.
5,246,415 A * 9/1993 Fuss ..... 493/28
6,206,816 B1 * 3/2001 Cook et al. ..... 493/420
6,406,416 B2 * 6/2002 Lindsay ..... 493/216
6,743,161 B2 * 6/2004 Dannemann et al. ..... 493/442

FOREIGN PATENT DOCUMENTS

DE 32 17 711 C1 11/1983
DE 41 23 130 A1 3/1992
DE 203 07 169 U1 7/2003
EP 1 193 206 A2 4/2002
EP 1 475 335 A1 11/2004

* cited by examiner

*Primary Examiner*—Sameh H. Tawfik
(74) *Attorney, Agent, or Firm*—Rothwell, Figg, Ernst & Manbeck, PC

(57) ABSTRACT

A buckle folding machine (10) includes an operator facing side wall (14) and a side wall (16) remote from an operator, the side walls (14, 16) being arranged at a distance from each other and at least one lower folding pocket (22, 24) being arranged between the side walls (14, 16). The lower folding pocket (24, 26) is guided in a cassette (28) for displacement from an operating position, in which it adjoins folding rolls (26), into a release position, in which it is located at a distance from the folding rolls (26), wherein the lower folding pocket (22, 24) is located outside of a coverage of the operator facing side wall (14) when in the release position, and wherein the cassette (28) is guided such that it can be displaced, perpendicular to the operator facing side wall (14), from an inserted position, in which the lower folding pocket (22, 24) is located within the buckle folding machine (10), into a withdrawn position, in which the lower folding pocket (22, 24) is located outside the buckle folding machine (10).

3 Claims, 2 Drawing Sheets

BUCKLE FOLDING MACHINE WITH FOLDING POCKET CASSETTE

BACKGROUND

1. Field of the Invention

The invention relates to a buckle folding machine having two side walls arranged at a distance from each other, between which at least one lower folding pocket is arranged.

2. Description of the Background Art

DE 32 17 711 C1 discloses a buckle folding machine whose folding pockets can be displaced, together or individually, in their longitudinal direction in order to permit adjustment of the folding pockets, the removal of blade shafts, or the insertion of sheet deflectors. The displacement is carried out via a shaft running at right angles to the long sides of the folding pockets, on which gears are arranged which can be engaged in a tooth profile on the long side of the folding pockets.

Even though the folding pockets can be displaced in their longitudinal direction, the access to the region of the folding rolls is restricted, so that an operator has to go under the buckle folding machine in order to carry out the adjustment work. The adjustment work is therefore awkward and time-consuming.

SUMMARY OF THE INVENTION

The invention is based on the object of using constructionally simple means to provide a buckle folding machine which makes it possible to carry out adjustment work in the region of the folding rolls quickly and simply.

This object is achieved by a buckle folding machine comprising an operator facing side wall and a side wall remote from an operator, said side walls being arranged at a distance from each other and at least one lower folding pocket being arranged between said side walls, wherein said lower folding pocket is guided in a cassette for displacement from an operating position, in which it adjoins folding rolls, into a release position, in which it is located at a distance from said folding rolls, wherein said lower folding pocket is located outside a coverage of said operator facing side wall when in said release position, and wherein said cassette is guided such that it can be displaced, perpendicular to said operator facing side wall, from an inserted position, in which said lower folding pocket is located within said buckle folding machine, into a withdrawn position, in which said lower folding pocket is located outside said buckle folding machine.

The design of the buckle folding machine according to the invention makes it possible to move the lower folding pockets out of the region of the buckle folding machine, so that the region of the folding rolls is freely accessible. This makes it possible to carry out adjustment work in a simple manner, such as the adjustment of the folding pockets or the fitting of sheet deflectors.

The lower folding pocket can preferably be moved from the operating position into the release position and back by means of a pneumatic device. A telescopic guide is preferably used for the lateral displacement of the cassette. The telescopic guide comprises two three-part telescopic rods, for example.

BRIEF DESCRIPTION OF THE DRAWINGS

An exemplary embodiment of the invention will be explained in more detail below by using the drawings, in which.

DETAILED DESCRIPTION OF THE INVENTION

Figure 1:
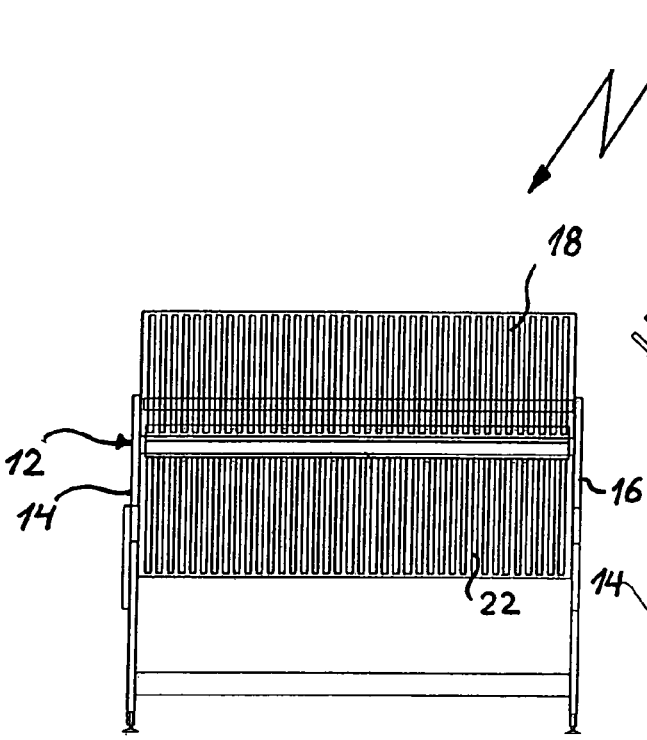
FIG. 1 shows a schematic front view of a buckle folding machine, in which the lower folding pockets are in an operating position.

The buckle folding machine 10 shown in FIGS. 1 to 6 comprises a frame 12 having two side walls 14, 16 arranged parallel to each other, between which upper folding pockets 18, 20 and lower folding pockets 22, 24 are arranged. Pairs of folding rolls 26 are provided between the upper folding pockets 18, 20 and lower folding pockets 22, 24.

Figure 2:
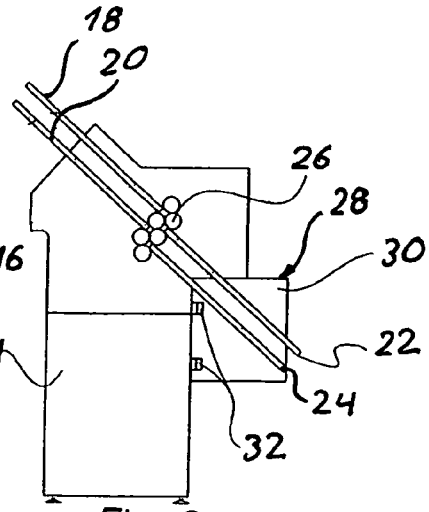
FIG. 2 shows a side view of the buckle folding machine from FIG. 1.
Figure 4:
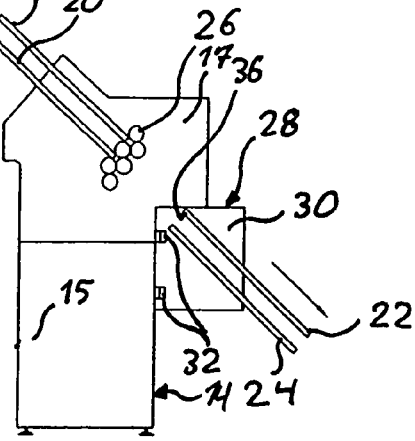
FIG. 4 shows a side view of the buckle folding machine from FIG. 3.
Figures 5, 6:
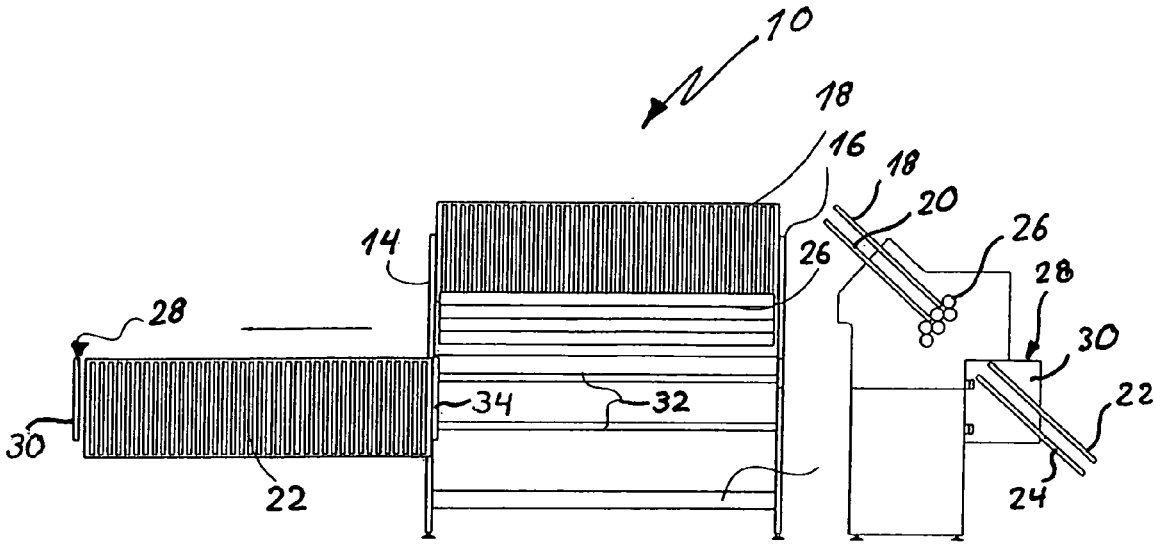
FIG. 5 shows a front view of the buckle folding machine from FIG. 1, a cassette being located in a withdrawal position.
FIG. 6 shows a side view of the buckle folding machine from FIG. 5.

As the side views of FIGS. 2, 4 and 6 show, the side wall 14 facing an operator has a leg 15 extending vertically from the floor, perpendicular to which a short leg 17 extends in the direction of folding rolls 22, 24. In the region in which the right-hand side edge of the lower leg 15 merges into the lower side edge of the upper leg 17, there is arranged a cassette 28 which comprises an operator-side side plate 30 and a side plate 34 facing away from the operator, which are connected to each other by struts. The folding pockets 22, 24 are fitted between the side plates 30, 34 in the cassette 28, being guided in their longitudinal direction in the cassette 28 by longitudinal guides (not shown).

The displacement of the folding pockets 22, 24 in their longitudinal direction can be effected by a pneumatic device.

The cassette 28 is in turn guided by three-part telescopic rods 32, which extend at right angles to the side walls 14, 16 of the buckle folding machine 10, adjacent to the right-hand edge of the lower leg 15. The telescopic rods 32 are fixed by one end to the sidewalls 16, go through the side plate 34 of the cassette 28 and are connected by the other end to the side plate 30.

In FIGS. 1 and 2, the lower folding pockets 22, 24 are shown in their operating position, in which their inlet openings are located adjacent to a corresponding pair of the folding rolls 26. The side plates 30 and 34 (FIG. 5) bear on the operator-side side wall 14 and on the side wall 16 facing away from the operator.

In order that it is possible to carry out adjustment work or other work in the region of the folding rolls 26, the lower folding pockets 22, 24 can be moved out in their longitudinal direction by means of the pneumatic device, as indicated in FIG. 4 by the arrow. The folding pockets 22, 24 are moved out to such an extent that they are located outside the coverage of the side wall 14 as can be seen in FIG. 4.

Figure 3:
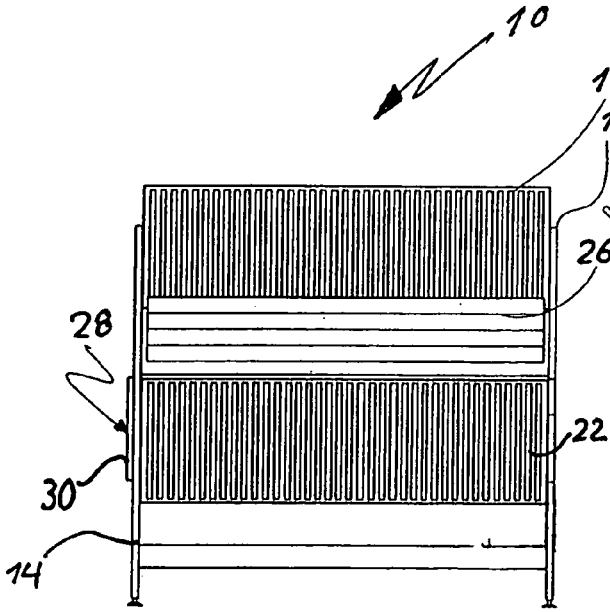
FIG. 3 shows a schematic front view of the buckle folding machine from FIG. 1, the lower folding pockets being in a release position.

Then, as indicated by the arrow in FIG. 5, the cassette 28 is pulled out from the inserted position shown in FIG. 3, at right angles to the side wall 14, into the withdrawn position shown in FIGS. 5 and 6 with the aid of the telescopic guide 32 until the folding pockets 22, 24 are located outside the buckle folding machine 10. The folding rolls 26 are then freely accessible. Adjustment work in the region of the folding rolls 26, such as the fitting of a sheet deflector, is then possible without hindrance. After the work has been carried out, the cassette 28 is pushed in again into the inserted position shown in FIG. 3. The folding pockets 22, 24 are then moved back again by means of the pneumatic device into their operating position, which is shown in FIGS. 1 and 2.

The invention claimed is:

1. A buckle folding machine comprising an operator facing side wall and a side wall remote from an operator, said side walls being arranged at a distance from each other and at least one lower folding pocket being arranged between said side walls, wherein said lower folding pocket is guided in a cassette for displacement from an operating position, in which it adjoins folding rolls, into a release position, in which it is located at a distance from said folding rolls, wherein said lower folding pocket is located outside of a coverage of said operator facing side wall when in said release position, and wherein said cassette is guided such that it can be displaced, perpendicular to said operator facing side wall, from an inserted position, in which said lower folding pocket is located within said buckle folding machine, into a withdrawn position, in which said lower folding pocket is located outside said buckle folding machine.

2. The buckle folding machine as claimed in claim 1, wherein said lower folding pocket can be pneumatically moved from said operating position into said release position and back.

3. The buckle folding machine as claimed in claim 1, wherein said cassette is guided by a telescopic guide.

* * * * *